United States Patent [19]

Lang et al.

[11] Patent Number: 4,725,732

[45] Date of Patent: Feb. 16, 1988

[54] PIN COROTRON AND SCOROTRON ASSEMBLY

[75] Inventors: Joseph H. Lang, Webster; Albert E. Burfeindt, Byron, both of N.Y.

[73] Assignee: Xerox Corporation, Stamford, Conn.

[21] Appl. No.: 881,144

[22] Filed: Jul. 2, 1986

[51] Int. Cl.[4] ..... H01T 19/04

[52] U.S. Cl. ..... 250/326; 250/324

[58] Field of Search ..... 250/324, 325, 326; 355/3 CH; 269/229, 230

[56] References Cited

U.S. PATENT DOCUMENTS

| | | | |
|---|---|---|---|
| 2,333,213 | 11/1943 | Slayter | 250/326 |
| 3,585,448 | 6/1971 | Simons | 361/230 |
| 3,619,719 | 11/1971 | Waller et al. | 361/230 |
| 3,643,128 | 2/1972 | Testone | 250/326 |
| 3,691,373 | 9/1972 | Compton et al. | 250/326 |
| 3,887,809 | 6/1975 | Marx et al. | 250/324 |
| 4,591,713 | 5/1986 | Gundlach et al. | 250/326 |

*Primary Examiner*—Bruce C. Anderson

*Attorney, Agent, or Firm*—Mark Costello

[57] ABSTRACT

A corona device comprising either a corotron or a scorotron for charging a surface is comprised of at least first and second complementary, interlocking pin array support members, at least one pin array member having integral pin projections and a power source extension member for connection to a high voltage power supply supported on and between the pin array support members, and a shield or screen member connected to a relatively low voltage, and supported externally on at least one of the pin array support members spaced from the pin array.

22 Claims, 3 Drawing Figures

PIN COROTRON AND SCOROTRON ASSEMBLY

This invention relates generally to corona devices for charging insulating surfaces, and more particularly to improved corotron and scorotron assemblies for charging the surfaces in a reproduction machine for reproduction processes.

CROSS REFERENCE

Cross-reference is hereby made to copending and earlier filed U. S. patent application Ser. No. 750,845, now issued as U.S. Pat. No. 4,646,196 to Reale and co-pending application entitled "Photoreceptor Deletion Control by Utilization of Corona Wind" Application Ser. No. 881,142, filed July 2, 1986 and assigned to the same assignee as the present application.

INCORPORATION BY REFERENCE

U.S. Pat. Nos. 3,691,373 to Compton et al., 4,592,713 to Gundlach et al., and 4,646,196 to Reale are incorporated herein by reference for the purpose of background information.

BACKGROUND OF THE INVENTION

Corona devices are known which are used in reproduction machines employing a photoconductive element to produce copies of documents to be reproduced. During reproduction processes such as xerography, it is necessary to apply charges to surfaces such as photoreceptor member or a copy sheet as part of the operation of the reproduction machine. For example, it is necessary to apply a uniform level of charge to the surface of a photoreceptor, which charge will subsequently be selectively dissipated by exposure to light. In xerographic processes, the non-discharged portions retain their charge in the form of a latent image on the photoconductive surface, and when subsequently brought into contact with toner material, will retain toner on the surface of the photoreceptor in the areas where the charge has not been dissipated. At a later time, a final support member, such as paper, transparencies, etc., may be brought into contact with the photoconductive surface, and a charge may be applied to the back side of the paper to attract the toner on the photoconductive surface to the support material. A detack arrangement may be provided to apply a neutralizing charge to the copy sheet to aid in its removal from the photoreceptor surface. A charge may be applied to the photoconductive surface as part of the removal of remaining toner from the photoconductive surface subsequent to transfer to clean the surface preparatory to reuse. The relatively large number of devices within a single machine require that the device be provided as inexpensively as possible.

In one type of preferred charging device, an electrically conductive electrode strip or coronode may be provided having projections, scalloped portions, or teeth members formed integrally with and extending from an edge of the strip. This arrangement has significant structural and operational advantages over other types of coronodes such as wires, including comparatively high structural strength and reduced undesirable ozone levels. In this respect, U.S. Pat. No. 3,691,373 to Compton et al. demonstrates a corona device generally comprising an electrically conductive electrode strip or pin array supported on either side by support strips, and held for use by a slotted member. The electrode is fixed into position by a plurality of transverse pins which fit through matching holes in the slotted member, pin array and support strips. An end portion is provided on one of the side strips for connection to an exterior connector from a high voltage source.

In copier manufacture, it is desirable to provide subassemblies within the copier to be constructed as simply and inexpensively as possible, while providing reliable operation. Additionally, since copiers tend to require a great deal of maintenance, subassemblies subject to regular maintenance requirements, such as the cleaning required for charging devices, should be easily removable and repairable, or inexpensive enough to simply discard if faulty or worn out. It is desirable when possible to make use of integral molded parts with a minimum of fasteners, and as few pieces as possible. Additionally, the assembly should be integrally provided with high voltage and assembly connectors to the main reproduction assembly so that it is easily inserted into position, it would also be desirable to provide a shield portion in close association with the assembly and provide the device with arc preventing features.

SUMMARY OF THE INVENTION

It is therefore an object of the present invention to provide a corona device assembly which accomplishes the above needs while providing a high degree of operability at a low manufacturing cost.

It is another object of the invention to provide a corona device assembly which makes maximum use of integrally molded parts providing ease of manufacture of the charging subassemblies.

It is yet another object of the invention to provide a corona device assembly with a minimum number of parts.

In accordance with the invention there is provided a corona generating member and support assembly which provides reliable surface charging operation comprising a minimum of assembled parts, and is potentially a low cost of manufacture device.

In accordance with one aspect of the present invention there is provided a corona generating assembly for charging a surface comprising at least first and second complementary, interlocking pin array supports; a pin array having integral pin projections and power source extension, supported on and between the first and second pin array support members; and a device shield supported externally on at least one of the first and second pin array supports spaced from the pin array.

In accordance with another aspect of the present invention there is provided a corona generating assembly comprising at least one generally rectangular corona generating member having first and second sides comprising the elongated length of the member, and first and second ends transverse to the sides. The first corona member side is provided with an array of projections formed integrally thereon and extending therefrom; and a plurality of support openings formed therethrough, and spaced along the length of the corona generating member at least one of the corona generating members ends comprises an extension member adapted for electrical connection with a high voltage contact. The corona member is supported between complementary support members at least one of which is provided with integral support projections for supporting the corona generating member thereon. The integral support projections are arranged on the support means at positions corresponding to said support openings formed in said corotron member for supportive engagement therewith. The support members are provided with complementary support projections receiving openings, and which allow the extension of the support projections therethrough for supporting the corona generating member therebetween. Fasteners engage with the support projections for securing the members in the assembly in operative relationship. Contact support extensions are provided on the support members for supporting integral shield and high voltage contacts, which are electrically connected to the shield and corona generating member, respectively.

In accordance with yet another aspect of the invention, a corotron charging device is provided comprising a corona generating member including a single pin array comprising a generally rectangular member having first and second sides comprising the elongated length of the member, and first and second ends transverse to the sides. The pin array member is provided with an array of projections formed integrally thereon and extending therefrom, and a plurality of support openings formed therethrough, and spaced along the length of the pin array member. At least one of the pin array members ends comprises an extension member adapted for electrical connection with a high voltage contact. The pin array member is supported between complementary first and second support members, at least one of which is provided with integral support projections for supporting the pin array member thereon while the complementary support member is provided with receiving openings corresponding to said support projections for engagement therewith allowing the extension of the support projections therethrough for supporting the pin array member therebetween. Shield members are provided enclosing and supporting the first and second support members, while providing a ground potential for the corona generating member and supported on the support projections. Fasteners engage with the support projections, exterior to the shield members, for securing the members in the assembly in operative relationship. Arc prevention members are provided support on the support projections at the interface between the first and second support members, and in abutting engagement with the pin array member to prevent electrical arcing from the corona generating member to the shield member along the support projections.

In accordance with still another aspect of the invention, a scorotron charging device comprises at least a pair of pin arrays as previously described. A central support member is provided with integral support projections for supporting the pin array members thereon while at least first and second complementary support side members are provided with receiving openings corresponding to said support projections for engagement therewith allowing the extension of the support projections therethrough for supporting the pin array members therebetween. A screen member comprising a conductive material connected to a low voltage potential and having a generally U-shaped cross section is supported on the central support member, and arranged between the pin array members and the surface to be charged. The upright sides of the screen member are held within the side supports to serve as a ground or shield potential. Air holes may be provided in side supports to allow the free movement of corona byproducts away from the charged surface, and to limit arcing from the pin arrays to the upright sides of the screen member.

These and other objects and advantages of the invention will become apparent as the following description is reviewed in conjunction with the accompanying drawings in which.

Figures 1, 2:
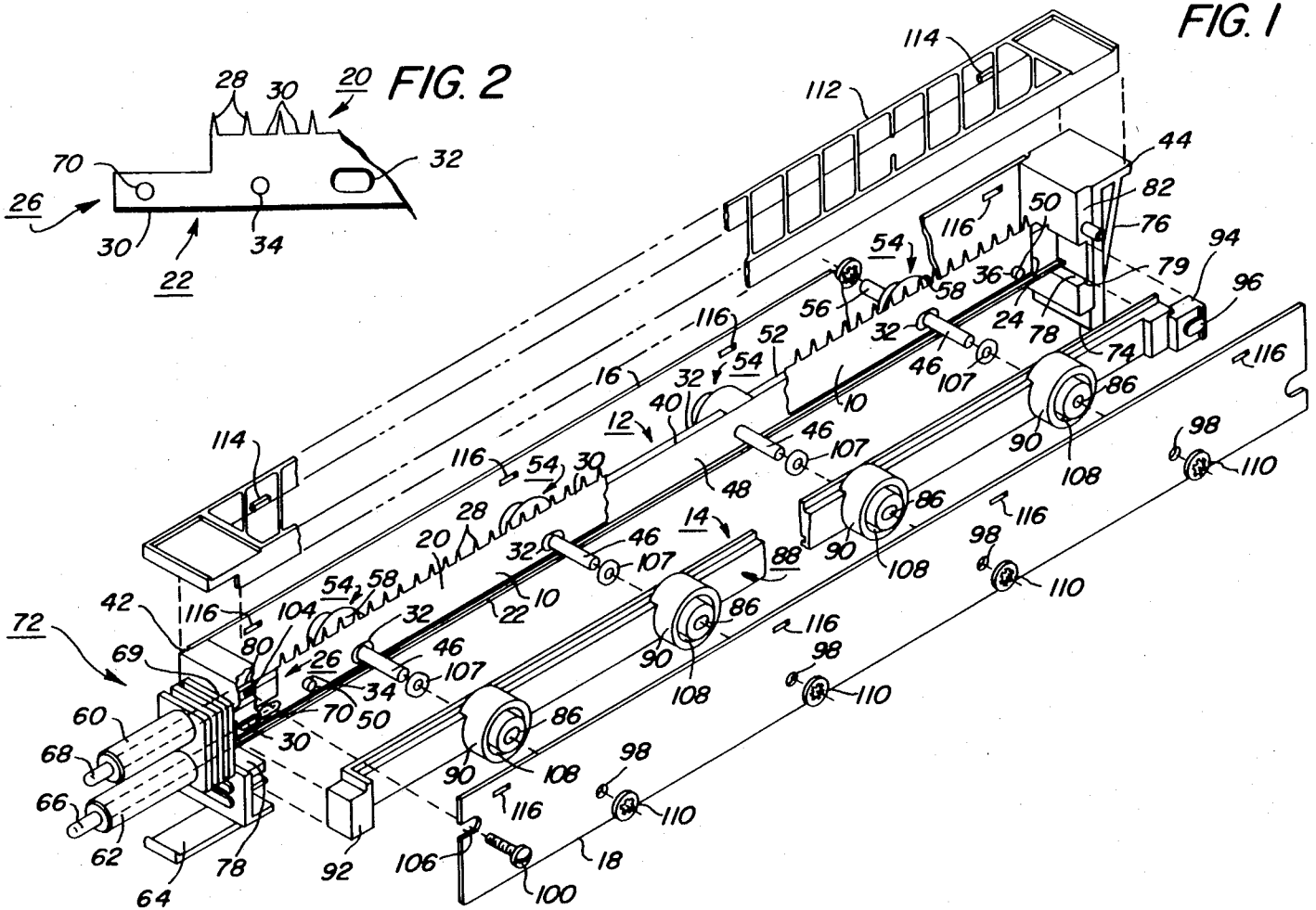
FIG. 1 is a perspective exploded and section view of a corotron in accordance with the invention.
FIG. 2 is a side view of a pin array in accordance with the invention.

Referring now to the drawings, wherein the showings are for the purpose of illustrating a preferred embodiment of the invention and not for the purpose of limiting same, FIG. 1 shows a corona generating device comprising a corotron in accordance with the present invention. As seen in FIG. 1, the corotron is generally comprised of a pin array 10, supported by first and second support members 12 and 14 which also support shield means comprising shield members 16 and 18 on either side of the corotron member, exterior to support members 12 and 14, respectively. As shown in FIGS. 1 and 2, pin array 10 is advantageously comprised of a thin rectangular member having sides 20, 22 and ends 24, 26; and formed of conductive material providing scalloped edges or teeth 28, and inter-teeth areas 30 along the length of side 20 extending toward a surface to be charged (not shown). Pin array end 26, best shown in FIG. 2, is provided with an integral high voltage extension member 30 for electrical connection of pin array 10 to a high voltage power source (not shown). Pin array 10 is provided with a plurality of support receiving openings 32 along the length thereof which will be further described hereinbelow. Support receiving openings 32 are slightly elongated in the direction of the length of the array in order to allow some degree of play in the placement thereof. The array may also, however, be provided with locator openings 34 and 36 generally proximate to either end thereof which will aid in the exact positioning of pin array 10 with respect to the corotron assembly. In a preferred embodiment of the invention, pin array 10 has a length approximately equal to the width of the surface to be charged, and in one embodiment is approximately 368 mm (145 inches) long, and suitable for copying operations using paper sheets having a B3 size. The array has a width large enough to provide clearance between support openings 32 and the base of teeth 28 without causing excessive weakness at the most proximate points, and exposing teeth 28 and interteeth areas 30 when mounted, which is required for proper charging characteristics. Teeth 28 may extend from inter-teeth areas 30 approximately 3.45 mm (0.136 inch) at a pin tip-to-pin tip pitch or frequency of about 3 mm (0.12 inches). The array member 10 may have a thickness of about 0.08 mm (0.003 inch).

Referring again to FIG. 1, first support member 12 is an elongated member comprising a support portion 40 extending between first and second integral mounting block portions 42 and 44. Support portion 40 is provided with a plurality of generally identical integral support projections 46 arranged along the length of a first support portion face 48 thereof, extending generally perpendicularly outwardly therefrom. For an array having the described size characteristics, four generally identical support projections 46 may be provided on support portion 40 to support pin array member. The projections of a preferred embodiment are generally extended outwardly about 19.2 mm (0.75 inch) from first face 48, and have a circular cross-section with a diameter of about 4 mm (0.16 inch). Support portion 40 may also be provided with a pin array locator means, complementary to locator opening 34 on pin array member 10, which may comprise two small pin members 50, integral with support portion 12, and extending slightly outwardly from first face surface 48 over which locator openings 34 may be placed to ensure proper placement of pin array 10 with respect to side support member 12. Extending in the opposite direction from support projections 46, from second face 52 of support portion 40, are a plurality of shield supports 54, which may correspond in number to support projections 46 on which shield member 16 may be supported. Shield supports 54 are also formed integrally with support member 40, and comprise a shield mounting projection 56 generally similar to support projections 46. Intermediate to shield mounting projection 46 and support portion 40 is a spacer portion 58 to maintain pin array 10 and shield member 16 supported on shield mounting projection 56 at an appropriate distance, as well as to increase the surface distance from pin array 10 to prevent arcing.

First mounting block portion 42 is provided with high voltage contact support portion 60 and shield voltage contact support portion 62 to support contacts to a high voltage power source (not shown) and a low voltage potential (not shown), respectively, formed integrally therewith; and a lateral locking spring member 64 for locking engagement with a latching assembly (not shown). In a preferred embodiment, contact support portions 60 and 62 are generally comprised of two parallel, spaced cylindrical members which support conductive high voltage contact member 66 and shield voltage contact member 68 extending outwardly from first mounting block portion 42, and extending through the support portions. High voltage contact member 66 connects to high voltage extension member 30 on pin array 10 through high voltage contact support portion 62 and mounting block 42 to support portion 40, wherein high voltage contact member 66 is provided with a flat portion 69 extending through the mounting block to present electrical connection point 70 flush with first face 48 for connection of pin array 10 to high voltage contact member 66. Intermediate contact support portions 60 and 62, and first mounting block portion 42 are creepage and clearance portions 72 integrally formed on side support member 12 and comprising an array of peaks and valleys formed on side support member 12 to increase the distance along the surface of side support member 12 between pin array member 10 when mounted, and the low voltage potential along the path of the low voltage potential contact member 68.

A seating slot member 74 and vertical spring locking member 76 are formed on second mounting block 44 to securely engage the corotron member within an assembly. Engaging connection means such as seating slot member 74 and vertical spring locking member 76 for securing a member into a fixed position within an assembly are well known, and may be comprised of a variety of types within the scope of the invention. Both first and second mounting block members 42, 44 are provided with seating slots 78, 79 on block faces 80, 82 for receiving second side support member 14.

Second side support member 14 is generally designed to complement first side support member 12. Accordingly, it is provided with support projection receiving openings 86 corresponding to support projection members 46, and allowing support projection members 46 to extend therethrough in close fitting engagement. On exterior face 88 of second side support member 14, exterior to pin array member 10, support projection receiving openings 86 are surrounded with shield spacer portions 90 similar to that described for first support member 14, which serve to maintain shield member 18 spaced appropriately from pin array 10. Insert portions 92 and 94 are provided at either extremity of second side support member 14, and are slidingly insertable within seating slots 78 and 79 in close fitting engagement. Insert portions 92, 94 also serve to level block faces 80, 82, to provide a flat abutment against which shield member 18 will lie. Either or both of insert portions 92, 94 or block faces 80, 82, may also include a locator pin 96 extending outwardly therefrom for appropriate positioning of shield member 18 with respect to the support arrangement.

Side support members 12 and 14 are advantageously manufactured with a nonconductive, somewhat rigid plastic material, which is injection molded to provide the desired shape. The conductive contact members may be easily molded into the support members simultaneously with their manufacture. In a preferred embodiment, the plastic is 30% glass filled to provide a degree of desired rigidity.

Shield members 16 and 20 are each generally comprised of stainless steel plates having a generally rectangular shape extending from mounting block 42 to mounting block 44. The shield members are provided with a plurality of shield mounting openings 98 corresponding in placement to mounting projections 46 and shield mounting projections 56. Shield members 16 and 20 each mount into position over these projections. A conductive connector member 100 is provided through a shield connector member opening 106 through the shield, and through mounting block connector member opening 104 where it will engage with the conductive contact member in the ground contact projection.

Arc prevention means are advantageously provided between pin array member 10 and shield member 18 to prevent arcing from the high voltage member to the shield. These may advantageously comprise an insulating O-ring member 107 seated around and about support projections 46, abutting pin array member 10 and blocking the potential arcing path from pin array member 10 to shield member 18 along support projections 46. For the same reasons, the support members are designed with a minimum of sharp edges which encourage arcing, and provided with extended surface shapes to increase the distance from pin array member 10 to shield members 16 and 18. For example, concentric recesses 108 surround support openings 86 on spacer portions 90 surrounding support projection receiving portions 86 to increase surface distance along the face of support members 12 to shield member 18. Similar concentric recesses may be provided on shield support 54. The recesses serve to prevent exposure of salt byproducts of corona emissions to the corona thereby preventing leakage of current across the salts from the coronodes to the shield.

Push fasteners 110 may be provided externally of shield members 16 and 18 for engagement with the projections to securely fasten the arrangement together. Alternatively, the projections may be hot staked and melted to expand their tips to be larger than the projection openings and securely engage the assembly together. To facilitate removal of the pin array coronodes from the arrangement, interlocking members such as screw tips and nuts may be provided.

For safety purposes a protective plastic lacing 112 comprised generally of a nonconductive material in the form of a grid having openings generally small enough to prevent finger and hand contact with exposed teeth 28 of pin array 10 may be mounted on shield members 16 and 18 over teeth 28 by a series of complementary tabs 114 and receiving slots 116.

The described device is easily assembled. Pin array 10 is mounted over support projections 46 on first support member 12 and positioned correctly by placing its locator openings 34 over locator pins 50. Extension member 30 is electrically connected, such as by soldering, to flat portion 70 of high voltage contact member 68 which extends through mounting block 42. O-rings 107 may be placed over support projections 46 in abutment with pin array 10. Support projection openings 86 on complementary second support member 14 are mounted over support projections 46, and insert portions 92 and 94 are slidingly inserted into seating slots 78, 79 on first and second mounting blocks 42, 44 to position first and second support members 12; 14 in supporting engagement with pin array 10. Shield member 18 is placed into position over support projections 46, spaced from pin array 10 by shield spacer portions 90, now surrounding the support projections. At least one end of shield 18 is positioned by placement of the shield over shield locator 96. Fastener 100 electrically and mechanically connects shield 18 to ground contact 68 and mounting block 42 when it is anchored through fastener opening 104. Push fasteners 110 are secured to the ends of the projection 46. In a like manner, shield 16 is positioned over shield mounting projections 56, and positioned a spaced distance from pin array 10, and secured in position with fasteners 110. Lacing 112 is secured via tab 114 and slot 116 connections, and the assembly is ready for use. The assembly is easily positioned by slot member 74, and secured to its position via spring locking members 64, 76, contact members 66 and 68 providing a plug-type connection for electrical engagement with exterior electrical structures. In the contemplated embodiments, the described corotron assembly may advantageously be used for toner transfer operating in the range of $-5.3$ kV peak to $-10$ kV peak with a negative square wave; for detack function operating in the range of $\pm 8$ kV peak to peak with a square wave; or preclean function operating with a square wave having a selected polarity duty cycle, and an approximately 16 kV swing, peak to peak.

Figure 3:
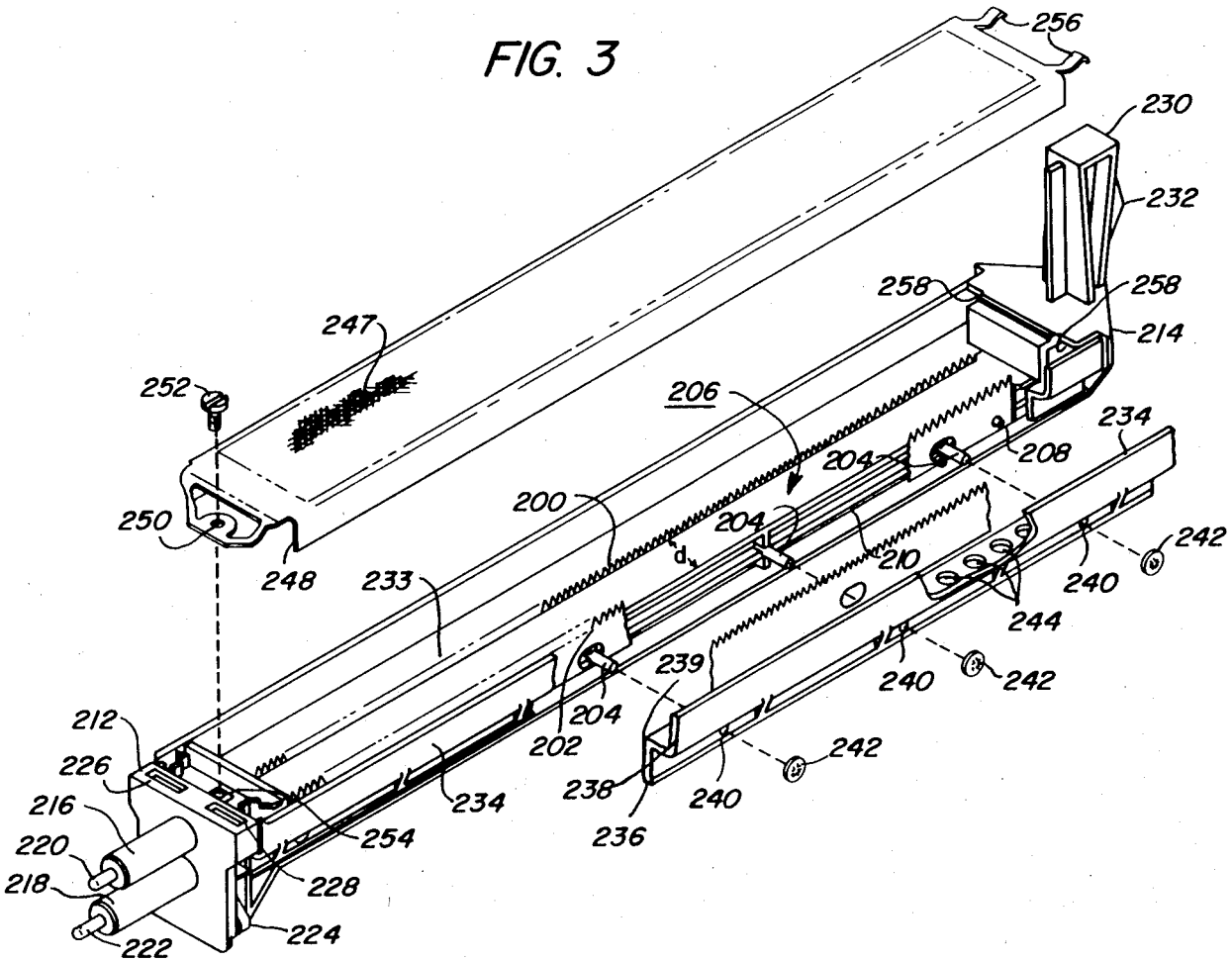
FIG. 3 is a perspective exploded and section view of a scorotron in accordance with the invention.

A similar construction scheme is used for the scorotron device. The scorotron device, as shown in FIG. 3, is characterized by having two pin array members, and a screen disposed between the pin arrays and the surface to be charged. The scorotron pin arrays 200 and 202, generally identical to the array described with respect to the corotron, are supported on support projections 204 extending outwardly in opposing directions from either side of a central support member 206 at generally corresponding positions in a manner similar to that described for the corotron, and spaced a distance d apart. The distance is chosen to be as large as possible consistent with the need for a compact device as smaller d spacings require greater power levels to drive the scorotron. Locator pin members 208 are provided on central support portion member 206 to correctly position pin array member 200 with respect thereto while another locator pin member (not shown) is slightly offset by a spacing amounting to ½ pitch position on the opposite side of central support member 206 to position the otherwise generally identical pin array member 202 in an offset position, such that the inter-teeth areas on pin array member 202 correspond in position to teeth on pin array member 200.

In much the same way as described for the corotron, central support member 206 is provided with a scorotron support portion 210 and mounting block members 212 and 214 on either end thereof. Scorotron support projections 204 extend outwardly from the scorotron support portion, from either side thereof in opposing directions. Projections 204 on either side of the support portion may be located at closely corresponding positions on scorotron support portion 210, which allows the advantage of using similar or identical side support members. Mounting block 212 supports contact support portions 216 and 218, each respectively supporting high voltage contact member 220 for connection with the pin array and low voltage contact member 222 in a manner similar to that as described for the corotron as well as a locking spring member 224 which engages with a receiving member in mounting to main reproduction machine assembly through locking spring slots 226, 228. Mounting block 214 supports an extension member 230 for insertion into a receiving slot to correctly position the scorotron in a reproduction machine, and locking member 232 which is suitable for engagement with a spring biased locking member on the main reproduction machine assembly.

Scorotron side support members 233 and 234 are generally identical members, and may advantageously be provided with a stepped cross section having first and second vertical portions 236 and 238, and a horizontal portion 239 joining them. First vertical portion 236 is provided with support projection receiving openings 240 corresponding to the support projections 204. In much the same way as described for the corotron member, pin array members 200 and 202 are supported for operation on support projections 204 between central portion 206 and one of side support members 233 and 234, with the assembly fixed into position with fasteners 242 or hot staking. One or both of scorotron side supports 233 and 234 may advantageously be provided with an opening or array of openings 244 along the junction of second vertical portion 238 and horizontal portion 239. Openings 244 serve to aid in the removal of corona byproducts from the area between the scorotron and the surface to be charged, which may damage the photoconductive surface. Additionally, openings 244 serve to aid in the prevention of arcing along the surfaces of scorotron side supports 233 and 234 toward screen member 246 which is supported closely adjacent thereto.

Screen member 246 is provided in a generally elongated member with a generally U-shaped cross section. The horizontally disposed central portion 247 is comprised generally of a grid pattern having in excess of about a 64% open area and parallel side portions 248 extending perpendicularly from central portion 247. Screen member 246 may be provided with a coating to reduce corona induced photoreceptor deletion. Screen member 246 is supported at either end on mounting blocks 212 and 214, and may advantageously be provided with a screw fastener receiving opening 250 disposed at one end which receives fastener member 252 through an opening 254 in mounting block 212 to low voltage potential contact member 222, and spring tongue members 256 which are insertable into receiving openings 258 in mounting block member 214.

The scorotron is assembled in much the same way as the corotron. Pin array members 200 and 202 are placed in position over support projections 204 with high voltage extension member soldered into position against. The pin array members are then secured into position on support projections 204 against central support portion 206 with side support members 233 and 234 with fasteners or hot staking the support projections. The scorotron is held in position at the mounting block portions, disposed to provide the contact support portions available for a plug-type connection to a power source. For the purposes of charging the photoreceptor surface in a reproduction machine, a voltage of between 6.5–10 Kv is applied to the high voltage contact member while a low voltage of −500 to −1500 v, or approximately the voltage level desired for the photoreceptor, is applied to the low voltage contact member.

The invention has been described with reference to a particular embodiment. Modifications and alterations will occur to others upon reading and understanding this specification. It is intended that all such modifications and alterations are included insofar as they come within the scope of the appended claims or equivalents thereof.

What is claimed is:

1. A corona device assembly for supporting a corona generating member to apply a charge to a surface in an electrophotographic device, comprising;

at least a first corona generating member having first and second sides comprising the elongated length of said member, and first and second ends, transverse to said sides, said first side having an array of projections formed integrally thereon and extending therefrom; said corona generating member provided with a plurality of support openings formed therein, and spaced along said length of said corona generating member; at least one of said ends comprising an extension member connected to a high voltage contact means;

at least first and second complementary side support members, at least one of said support members having integral support projections extending outwardly therefrom, for supporting said at least first corona generating member with said array of projections extending therefrom towards a surface to be charged, said integral support projections arranged on said support member at positions corresponding to said support openings formed in said corotron member for supportive engagement therewith;

at least said second complementary side support member having support projection receiving openings corresponding to said support projections for engagement therewith, for interlockingly supporting said corona generating member therebetween; and shield means mounted on at least one of said first and second support members and comprising conductive material laterally spaced from said corona generating member, and low voltage connection means for connecting said shield means to a device low voltage potential.

2. A corona device assembly as defined in claim 1 wherein said shield means further comprises first and second side shield members.

3. A corona device assembly as defined in claim 2 wherein said at least one of said support members having integral support projections for supporting said at least first corona generating member also comprises integral shield support projections extending from said support member in a direction opposite the corona generating member support projections.

4. A corona device assembly as defined in claim 3 wherein said first and second side shield members are supported on said shield and corona generating member support projections, exterior to said support members relative to said corona generating member.

5. A corona device assembly as defined in claim 1 wherein one of said first and second support members further comprises an integral high voltage contact means for receiving said extension member, and providing operative connection of said extension member with an exterior high voltage source.

6. A corona device assembly as defined in claim 1 further comprising fastener means engaging with said support projections for securing said first and second support members, and said corona generating member in operative relationship.

7. A corona device assembly as defined in claim 4 further comprising fastener means engaging with said shield and corona generating member support projections for securing said first and second support members, said first and second side shield members, and said corona generating member in operative relationship.

8. A corona device assembly as defined in claim 1 wherein one of said first and second support members further comprises an integral shield contact means for receiving said low voltage connection means, and adapted to provide operative connection of said low voltage connection means with an exterior device low voltage potential.

9. A corona device assembly as defined in claim 1 wherein said corona generating member support projection openings further comprising current leakage prevention means surrounding said corona generating member support projection openings to prevent current leakage from the corona generating member to said shield means along the corona generating member support projections.

10. A corona device assembly as defined in claim 9 wherein said current leakage prevention means comprises an annular recess surrounding said corona generating member support projection openings, whereby corona byproducts deposited therein remain unexposed to corona generated by said corona generating means.

11. A corona device assembly as defined in claim 3 wherein said integral shield support projections further comprising current leakage prevention means surrounding said integral shield support projections to prevent current leakage from the corona generating member to said shield means along the corona generating member support projections.

12. A corona device assembly as defined in claim 1 wherein said first and second support members each further comprise an integral injection molded nonconductive insulating plastic member.

13. A corotron assembly to apply a charge to a surface in an electrophotographic device comprising:

a corona generating member including a pin array coronode comprising a generally rectangular member having first and second sides comprising the elongated length of the member, and first and second ends, transverse to said sides, said pin array coronode having an array of projections formed integrally thereon and extending therefrom, and a plurality of support openings formed therethrough, and spaced along the length of the pin array member, at least one of the pin array coronode ends comprises an extension member electrically connected to a high voltage contact;

complementary first and second side support members, at least one of said support members having integral support projections for supporting said pin array coronode thereon with said array of projections extending therefrom towards a surface to be charged, while the complementary support member is provided with receiving openings corresponding to said support projections for engagement therewith and allowing the extension of the support projections therethrough, for interlockingly supporting the pin array coronode therebetween;

conductive shield means supported on the support projections for close engagement with said first and second side support members exterior to said pin array coronode and having ground connection means for connection of said shield mean to an exterior ground potential.

14. A corotron assembly as defined in claim 13 and further comprising fastener means engaging with said support projections, exterior to the shield means, for securing the pin array coronode, first and second support members, and shield means in operative relationship.

15. A corotron assembly as defined in claim 13 and further comprising current leakage prevention means surrounding said support projections to prevent electrical current flow from the corona generating member to the shield means along the support projections.

16. A corotron assembly as defined in claim 15 wherein said current leakage prevention means comprises annular recesses formed in said support members and surrounding said support projections.

17. A scorotron assembly for charging a surface in an electrophotographic device to a uniform potential comprising:

corona generating means including at least a first pin array coronode comprising a generally rectangular member having first and second sides comprising the elongated length of the member, and first and second ends transverse to said sides, said pin array coronode having an array of projections formed integrally thereon and extending therefrom, and a plurality of support openings formed therethrough, and spaced along the length thereof, at least one end of said pin array coronode comprising an extension member adapted for electrical connection with a high voltage contact;

a central support member having integral support projections adapted to extend through said support openings for supporting the pin array coronode thereon with said array of projections extending therefrom towards a surface to be charged;

complementary side support members, provided with receiving openings corresponding to said support projections on said central support member for engagement therewith, whereby said pin array coronode is supported between the central support member and a side support members; and an elongated screen member comprising a conductive material connected to a predetermined voltage potential and having a generally U-shaped cross section, supported on the central support member between the pin array coronode and a surface to be charged.

18. A scorotron assembly as defined in claim 17 wherein said elongated screen member is supported at either end on the central support member.

19. A corona device assembly for charging a surface in an electrophotographic device, comprising at least first and second complementary, interlocking pin array support members;

at least a first pin array coronode having integral pin projections and power source extension member, supported on and interlocked between said first and second pin array support members; and conductive shield means, supported externally on at least one of said first and second pin array support members, spaced from said pin array member.

20. A corona device assembly as defined in claim 19 wherein at least one of said first and second pin array support members integrally comprises a contact member for connecting said pin array power source extension member to an external power supply.

21. A corona device assembly as defined in claim 20 and further comprising a third pin array support member complementary to at least one of said first and second pin array support members; and a second pin array member having integral pin projections and power source extension member, supported on and between said third pin array support member and said at least one of said first and second pin array support members.

22. A corona device assembly as defined in claim 21 wherein said shield means further comprises a screen member support on at least one of said first, second and third support members disposed between said pin array member and a surface to be charged.

* * * * *